US007159748B2

(12) United States Patent
Gerlach et al.

(10) Patent No.: US 7,159,748 B2
(45) Date of Patent: Jan. 9, 2007

(54) STAPLING DEVICE

(75) Inventors: Thomas Gerlach, Tuttlingen (DE); Dirk Droge, Neuhausen ob Eck (DE)

(73) Assignee: Hohner Maschinenbau GmbH, Tuttlingen (DE)

( * ) Notice: Subject to any disclaimer, the term of this patent is extended or adjusted under 35 U.S.C. 154(b) by 88 days.

(21) Appl. No.: 10/717,543

(22) Filed: Nov. 21, 2003

(65) Prior Publication Data

US 2004/0108355 A1 Jun. 10, 2004

(30) Foreign Application Priority Data

Nov. 22, 2002 (DE) ..... 10254805

(51) Int. Cl.
*B25C 7/00* (2006.01)

(52) U.S. Cl. ..... 227/155; 227/110; 227/1.11

(58) Field of Classification Search ..... 227/7, 227/44, 78, 110, 111, 155
See application file for complete search history.

(56) References Cited

U.S. PATENT DOCUMENTS 3,735,978 A * 5/1973 Turner et al. ..... 271/178
4,516,714 A * 5/1985 Braun et al. ..... 227/78
4,614,290 A * 9/1986 Boss ..... 227/1
5,005,751 A * 4/1991 Radtke et al. ..... 227/111
5,174,557 A 12/1992 Meier
5,772,198 A * 6/1998 Yamamoto ..... 270/58.12
6,142,353 A * 11/2000 Boss et al. ..... 227/44
2002/0060388 A1 5/2002 Wakabayashi
2003/0061700 A1 * 4/2003 Steinert et al. ..... 29/592

FOREIGN PATENT DOCUMENTS

DE 38 39 306 A1 11/1988
DE 197 22 298 A1 5/1997
DE 697 03 469 T2 8/1997
DE 197 50 143 A1 11/1997
DE 197 50 143 5/1999
EP 916515 A1 * 5/1999

* cited by examiner

*Primary Examiner*—Louis K. Huynh
*Assistant Examiner*—Nathaniel Chukwurah
(74) *Attorney, Agent, or Firm*—Breneman & Georges

(57) ABSTRACT

A stapling device (1) with at least two stapling heads (4, 5) attached to a stapling head unit (2) for stapling sheet-like material, in particular paper, cardboard or the like, is provided, wherein the distance between at least two stapling heads (4, 5) can be adjusted relative to each other. In a stapling device (1) according to the invention, the retrofitting necessary for various products is to be simplified. This is achieved in the invention by moveably arranging the stapling heads (4, 5) relative to each other, and providing a drive unit (9, 10) for setting the stapling head distance.

22 Claims, 2 Drawing Sheets

STAPLING DEVICE

CROSS REFERENCE TO RELATED APPLICATIONS

None

STATEMENT TO A "SEQUENCE LISTING", A TABLE OR COMPUTER LISTING APPENDIX

Figure 1:
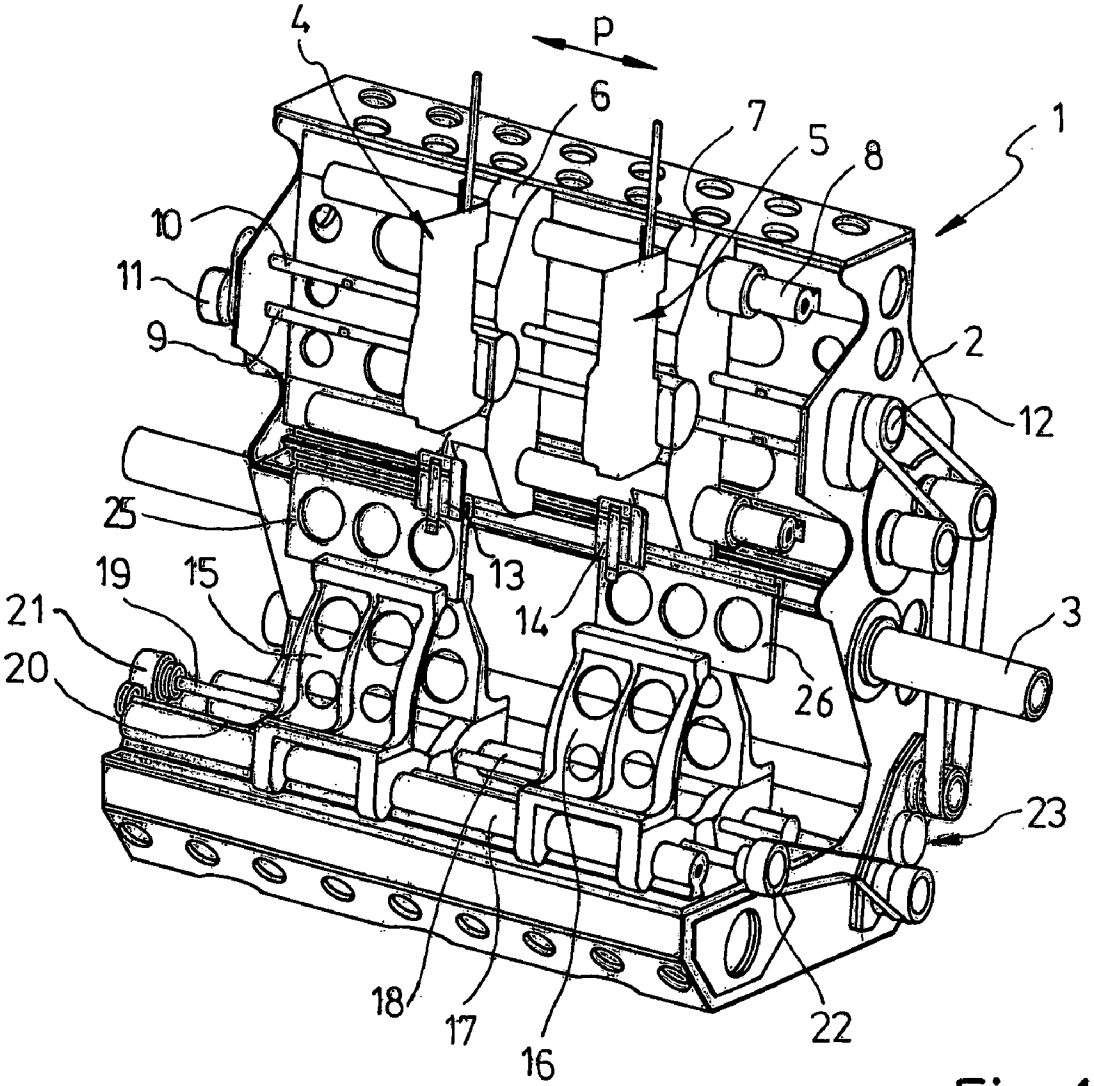

Not Applicable.

BACKGROUND OF THE INVENTION (1) Field of the Invention

The invention relates to a stapling device with at least two stapling heads attached to a staple carriage for stapling sheet like material wherein the distance between the stapling heads can be adjusted relative to one another.

(2) Description of Related Art Including Information Disclosed Under 37 CFR 1.97 and 1.98

Sheet-like material, in particular paper, cardboard or the like, is stapled using machines with so-called stapling heads, which are able to cut a required length of wire provided by a supply roll, shape the cut piece into a staple, drive the staple into the material to be stapled, and then impart the final staple shape by bending the staple ends.

Such stapling heads are used in so-called gather-staplers, for example, which have a gathering and transporting unit that compiles the material to be stapled and relays it to stapling. A staple carriage with two or more stapling heads is moveably secured in a section of the gathering and transporting unit, and staples together the material to be stapled, while the gathering and transporting unit keeps moving, i.e., the staple carriage travels synchronously with the material to be stapled during the stapling process, so that its transport is not stopped, but stapling rather takes place while in motion.

Depending on the type and size of the material to be stapled, the stapling heads must here be spaced apart at varying distances. In known gather-staplers (e.g., see DE 197 50 143 A1), the distance between stapling heads has thus far been set manually before starting up the machine, wherein the stapling head mount is removed from the staple carriage to this end.

Retrofitting such a gather-stapler hence involves a corresponding shutdown of the machine and, if necessary, the provision of appropriate personnel.

The same problem is also encountered in stapling machines in which the material to be stapled is conveyed into a stationary stapling device, stapled there and then transported away.

BRIEF SUMMARY OF THE INVENTION

Proceeding from this prior art, the object of the invention is to provide a stapling device for use in stapling machines that simplifies the retrofitting necessary for various products.

This object is achieved with a device having at least two stapling heads in which at least one stapling head is moveable and one drive unit is provided for setting the distance between the stapling heads.

The measures, advantageous embodiments and further developments of the invention include the addition of two clinchers in which at least one clincher is moveable and one drive unit is provided for setting the distance between the clinchers, the provision of a guide for moveably accommodating the stapling heads and/or clinchers, the application of electrically, electronically, pneumatically and/or a hydraulically activated drive, the coupling of the stapling head and clincher drive, the provision of a linear guide for the stapling heads and/or clinchers, the joining of the guide with the stapling head unit, the application of a spindle drive for setting the distance between the stapling heads and/or clinchers, employing a position sensor, the provision of a reference position for at least one stapling head and/or clincher, the provision of a position controller, the provision of a locking device for at least one stapling head and/or clincher, providing a drive for the locking device, utilizing electrically, pneumatically or hydraulically actuated means for actuating the locking device, designing the locking device as a clamping device, fixing the clamping device relative to the stapling carriage, connecting the moveable clamping component with the stapling head and/or clincher, providing a clamping device with a pressure and/or tension component that exerts a force perpendicular to the shifting direction of the corresponding stapling head and/or clincher, and utilizing a pressure piston in the clamping device.

The invention is hence characterized in that the stapling heads are moveably arranged relative to each other, and that a drive unit is provided for setting the stapling head distance.

This makes it significantly easier to adjust the stapling head distance, thereby markedly reducing the retrofitting times and eliminating the need to remove parts.

In a special embodiment of the invention, the clinchers are also correspondingly adjusted with at least one movable clincher by means of a drive unit. The staple end on the clincher is bent after piercing through the material to be stapled. This makes it necessary to position the clincher while positioning the stapling head. Basically, this can be accomplished by assembling the stapling head and clincher on a common, movable wagon.

In another advantageous embodiment, however, the guides for the movable clincher(s) and movable stapling head(s) are separate from each other. In this design, the drive for moving a clincher is advantageously coupled with the drive for the accompanying stapling head, e.g., mechanically or, if need be, electrically or electronically, so that the clincher position is always adjusted to the stapling position. The advantage to this particular embodiment is that the space between the stapling head and clincher is completely devoid of mechanical components, so that it can be better used for the transporting unit for the material to be stapled.

In an advantageous further development of the invention, the drive unit for the stapling heads and/or clinchers is designed so that it can be actuated. This actuation preferably takes place electrically or electronically, but can also be accomplished by other means, e.g., pneumatically or hydraulically. The advantage to an actuatable drive unit in a device according to the invention is basically that the distance between the stapling heads and/or clinchers is changed automatically. Such a stapling device can here be incorporated in a fully automated system, e.g., which, if needed, automatically controls the stapling process given the provision of varying materials to be stapled.

In order to make the stapling heads and/or clinchers movable, a guide is preferably provided to direct the motion of the stapling heads and/or clinchers. This type of guide is designed as a linear guide in an advantageous embodiment. A linear guide reflects a kind of motion required for changing distances on the one hand, and can be realized at a low cost and simultaneously high precision and stability in comparison to swivel or lever mechanisms on the other.

Moreover, such a linear guide can be rigidly joined with the corresponding stapling head unit, resulting in a mutual interaction to improve stability. The linear guide hence improves the stability of the stapling head unit, while the stapling head unit improves the stability of the linear guide as a result of the rigid connection.

To enhance this effect, the linear guide is supported against the stapling head unit essentially over the entire length. The resultant increased stability also makes it possible to reduce the weight of the linear guide, and hence the entire stapling device, through the implementation of appropriate structural measures to save on materials or the corresponding selection of materials.

There are great advantages to a lighter stapling head unit, in particular when combined with the aforementioned gather-staplers, in which the stapling head unit is movable in design as a so-called staple carriage, since acceleration and deceleration of the stapling head unit is easier, so that less effort is required for drive and control purposes.

A spindle is preferably used as the drive unit for adjusting the stapling head distance and/or clincher distance. The distance can be set using a spindle without major additional structural modifications by means of a motor, which imparts rotation to the spindle. In addition, selecting an appropriate spindle makes it possible to introduce highly precise adjustments, if necessary at correspondingly high setting forces. Another advantage to the spindle is that the drive can be made self-locking, i.e., the motor only has to be powered for purposes of movement.

If need be, however, the stapling head and/or clincher position can be fixed even for a spindle by using an appropriate motor design, e.g., a stepping motor with holding torque.

In a special embodiment of the invention with spindle drive, only one stapling head and/or only one clincher is moveably driven by a spindle, while another stapling head and/or clincher is statically arranged relative to the stapling head unit. Two spindle drives can also be used to move two stapling heads and/or two clinchers into virtually any position desired independently of each other. For example, a spindle with a left-hand and right-hand thread and corresponding spindle nuts can basically be used to drive the stapling heads and/or clinchers in such a way as to drive two stapling heads or two clinchers in opposite directions to set the desired distance between the stapling heads or between the clinchers.

If more than two stapling heads or clinchers are provided, the desired distance can be set using two or more spindles, but also using spindle sections with varying pitches.

The drive for setting the stapling heads and/or clinchers is preferably electrical in design, which is enabled by combining a spindle drive with electric motor as described above, for example.

However, other drive variations are basically also possible, e.g., pneumatic or hydraulic drives with corresponding motors or cylinders.

In a further development of the invention, a position sensor is provided for at least one stapling head position and/or at least one clincher position.

This one stapling head position and/or clincher position can, for example, represent a reference position, which is used as the basis for establishing the respective set position. This ensures that the set position is always approached under identical conditions, in particular from the same direction, so that a mechanical play in the drive unit or even the gear unit always generates an effect that is reproducible, and hence to be taken into account when setting the position.

Such a position sensor can also be used as position switch to avoid undesired extreme positions that might be caused by a stapling head or clincher approaching other components.

Continuous position detection over a specific range of settings to be assumed by the stapling head or stapling heads and/or the clincher or clinchers offers even greater advantages. On the one hand, this makes it possible to monitor the actually set stapling head and/or clincher position. On the other hand, actual position acquisition can also be used for position control. A corresponding control circuit hence makes it possible to reliably set the respective position. The outlay of effort necessary to realize the drive and setting unit can here be reduced, since the desired set position is also found via position control even given certain fluctuations in position reproducibility owing to drive and setting unit tolerances.

In a particularly advantageous further development of the invention, an additional locking device is provided, which fixes the set position of the stapling head or stapling heads and/or the clincher or clinchers. Such an additional locking unit is advantageous in particular in moving staple carriages of the kind described above, since high accelerations not intended to impact the stapling head and/or clincher position must here be absorbed. When using an additional locking device, the drive unit and setting unit must only absorb part, if any, of these forces.

Also preferably provided is a drive, if possible a controllable drive for operating the locking device, to further enable the largely automated operation of the device according to the invention.

In a special embodiment, the locking unit is designed as a clamping device. A clamping device can be made readily detachable, and in addition can be used at any time over a specific covered distance in varying positions.

The drive for the locking device can here be electrical, pneumatic and/or hydraulic in design. If necessary, inserted transmission components can be provided for actuating the locking device, e.g., a bond train, lever system or the like.

The clamping device is realized, for example, by providing a clamping component that moves relative to the stapling head unit, and a clamping component that is fixed relative to the stapling head unit. Actuating the movable clamping component here produces the desired locking effect.

A movable clamping component is preferably designed to move with the stapling head and/or [clincher] or secured to the latter. This configuration makes it easier to clamp the stapling head and/or clincher in various positions, wherein a clamping component extending over the entire range of adjustment, e.g., in the form of a clamping rail or the like, would essentially also be conceivable for use in fixing the stapling head or stapling heads and/or the clincher or clinchers in various settings.

The clamping component fixed relative to the stapling unit is preferably designed separate from the guide, in particular in the case of a linear guide. This makes it possible to avoid an additional load on the stapling head or clincher guide.

To actuate the movable clamping component, a pressure and/or tension component is advantageously also provided, if possible acting perpendicular to the shifting direction. This perpendicular exposure to forces exerted by the provided pressure and/or tension component prevents the stapling head and/or clincher from undesirably shifting in its guide upon actuation of the clamping device or pressure and/or tension component.

In a preferred embodiment of the invention, a pressure piston is provided as a movable clamping component. Such a pressure piston, e.g., a pneumatic or hydraulic pressure piston, can be secured to a movable stapling head and/or a movable clincher without any problem, and activated in different positions.

In addition, it is advantageous for a clamping drive to be provided with a force transmission device to actuate the movable clamping element. Despite the application of high clamping forces, the drive can as a result be given small dimensions, thereby reducing the expense. Toggle levers and/or spline rollers can be used as the clamping drive with force transmission device.

After actuation, the clamp can be mechanically locked, e.g., via spring resistance, or maintained by the corresponding actuating medium, e.g., compressed air or hydraulic fluid. It is only important that the locking device be reliably locked when the desired stapling head and/or clincher position has been set, and operations are initiated in which the stapling device according to the invention is moved and exposed to corresponding acceleration forces in the process.

A stapling device according to the invention is preferably used in conjunction with a staple carriage of a gather-stapling machine which is designed to move material to be stapled during the stapling operation. These gather-stapling machines are characterized in that a staple carriage or staple wagon is entrained in the motion of the stack of sheets in the gathering and transporting unit that are to be stapled during the stapling process, so that stapling takes place during transport of the material to be stapled. Therefore, the material to be stapled need not be stopped or decelerated for stapling purposes, and then accelerated again for continued transport. However, the staple carriage or staple wagon is exposed to corresponding deceleration and acceleration movements so as to execute the synchronous motion during the stapling process on the one hand, and return to the start position again for the next stack of sheets on the other.

BRIEF DESCRIPTION OF THE SEVERAL VIEWS OF THE DRAWING(S)

An embodiment of the invention is shown in the drawing, and shall be explained in greater detail below based on the figures.

Figure 2:
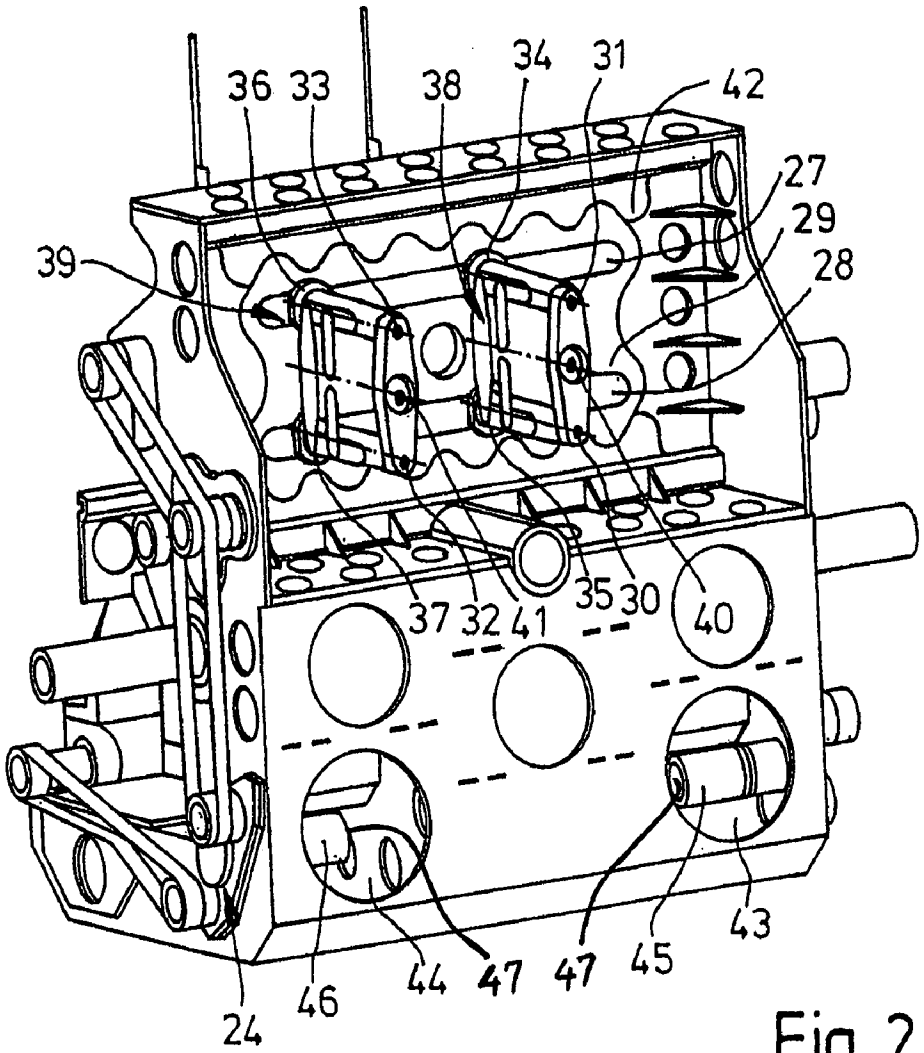

Shown on:

FIG. 1 is a perspective view of a device according to the invention, inclined, viewed from the front, and on FIG. 2 is a perspective view of the device, inclined, viewed from the back.

DETAILED DESCRIPTION OF THE INVENTION INCLUDING BEST MODE

The stapling device 1 according to FIG. 1 comprises a stapling head unit in the form of a movable staple carriage 2, which is mounted on a linear guide 3 so that it can shift. The staple carriage can be moved synchronously with a gathering and transporting unit to gather and transport the material to be stapled, and hence can be used in a so-called gather-stapler.

Two stapling heads 4, 5 are secured to the staple carriage 2 in such a way that they can shift in the direction of the double arrow P. The stapling heads 4, 5 are here each mounted on a stapling head wagon 6, 7. The stapling head wagons 6, 7 envelop two linear guides 8, along which movement in the direction of the double arrows P takes place.

A spindle 9, 10 is provided for driving the shifting motion. The spindle 9 is here engaged with a female thread (not shown in any greater detail) of the stapling head wagon 6, while the spindle 10 is engaged with a corresponding female thread (also not shown in any greater detail) of the stapling head wagon 7. Accordingly, the spindle 9 intersects the stapling head wagon 7 without any frictional connection, while the spindle 10 intersects the stapling head wagon 6 without any frictional connection.

A crown gear 11 drives the spindle 9 on one side of the staple carriage 2, while another crown gear 12 drives the spindle 10 on the other face.

Two so-called clinchers 13, 14 are mounted below the stapling heads 4, 5 on accompanying clincher wagons 15, 16. The clinchers 13, 14 are used to bend the staples after they have been driven into the material to be stapled. The clincher wagons 15, 16 are channeled in linear guides 17, 18, and are driven by two spindles 19, 20 to mirror the stapling head wagons 6, 7, so that the clincher wagons 15, 16 carrying the clinchers 13, 14 move synchronously with the stapling head wagon 6, 7.

As visible from the face, the spindles 19, 20 are driven by two additional crown gears 21, 22, wherein the drive is positively coupled with the belt drive of the stapling head wagons 6, 7 by a toothed gearing 23, 24 (see FIG. 2).

The clinchers 13, 14 are bolted just as the spacers 25, 26 used to secure the clinchers 13, 14 to the respective clincher wagons 15, 16, which makes them replaceable. This is advantageous when retrofitting to other clamp sizes and performing maintenance and repair work.

Discernible on FIG. 2 are two longitudinal slots 27, 28 in a type of intermediate wall 29, which are each intersected by two bolt mounts 30, 31, 32, 33. The bolt mounts 30, 31, 32, 33 are rigidly connected with the stapling head wagons 6, 7 on the opposing side of the intermediate wall 29.

Two respective pressure pistons 34, 35, 36, 37 abut the intermediate wall 29 in the lateral area of the slots 27, 28, thereby clamping the respective stapling head wagon 6, 7 to the intermediate wall 29. A respective toggle lever mechanism 38, 39 is provided for tensioning the pressure pistons 34, 35, 36, 37. The toggle lever mechanism 38, 39 can be spring mounted, for example, but also be pneumatically, hydraulically or electrically braced and released. In this embodiment, two pneumatic cylinders 40, 41 are provided for releasing spring-mounted toggle lever mechanisms 38, 39. As a result, pneumatic actuation is only necessary-during the adjustment process.

The toggle lever mechanisms 38, 39 with the pressure pistons 34, 35, 36, 37 fix the stapling head wagons 6, 7 in the desired position via clamping to the intermediate wall 29. This is particularly advantageous when using the entire device 1 as the staple carriage 2, which moves along the linear guide 3 synchronously with the material to be stapled. In each stapling step, the stapling device 1 must in this case be accelerated, stopped, returned, stopped again and accelerated once more. The acceleration forces arising here need only be partially absorbed by the spindle drives 9, 10 in this embodiment. The clamping device intercepts most of acceleration forces via the pressure pistons 34, 35, 36, 37 and the intermediate wall 29.

Also discernible in the back on FIG. 2 is that the linear guide 8 is bolted with the staple carriage 2 essentially over its entire length by equidistant fastening bolts 42. This improves the stability of the linear guide and the housing of the staple carriage 2, making it possible to reduce the weight of the linear guide or housing via appropriate material savings or selection.

The arrangement of both drive motors 45, 46 for driving the stapling wagons 6, 7 or clincher wagons 15, 16 is also evident from the recesses 43 and 44 on FIG. 2. The drive motors 45, 46 are accommodated inside the housing of the staple carriage 2, so that they do not outwardly project. A position sensor 47 is provided for at least one stapling head position and/or at least one clincher position.

A locking or clamping device is only provided for fixing the stapling heads in the embodiment shown, but not for the clinchers. Depending on the embodiment, however, a corresponding locking device can also be provided for the clinchers.

REFERENCE LIST

1 Stapling device
2 Staple carriage
3 Linear guide
4 Stapling head
5 Stapling head
6 Stapling head wagon
7 Stapling head wagon
8 Linear guide
9 Spindle
10 Spindle
11 Crown gear
12 Crown gear
13 Clincher
14 Clincher
15 Clincher wagon
16 Clincher wagon
17 Linear guide
18 Linear guide
19 Spindle
20 Spindle
21 Crown gear
22 Crown gear
23 Toothed gearing
24 Toothed gearing
25 Spacer
26 Spacer
27 Slit
28 Slit
29 Intermediate wall
30 Bolt mount
31 Bolt mount
32 Bolt mount
33 Bolt mount
34 Pressure piston
35 Pressure piston
36 Pressure piston
37 Pressure piston
38 Toggle lever mechanism
39 Toggle lever mechanism
40 Pneumatic cylinder
41 Pneumatic cylinder
42 Fastening bolts
43 Recess
44 Recess
45 Drive motor
46 Drive motor

The invention claimed is:

1. A stapling device with two or more stapling heads for stapling sheet-like material, wherein the improvement comprises a staple carriage having at least two or more stapling heads wherein at least one stapling head (4, 5) is adjustable to the other and a staple head drive unit (9, 10, 45, 46) is provided for setting the distance between the stapling heads (4, 5) and a clincher assembly having at least two clinchers (13, 14) with a clincher drive unit (19, 20, 45, 46) for adjusting at least one clincher and a clamping device (34, 35, 36, 37) wherein said two clinchers and said two or more stapling heads move longitudinally in substantially synchronous movement with said sheet like material during stapling and said clamping device includes a pressure component (34, 35, 36, 37) to exert a force perpendicular to the shifting direction of the corresponding said at least one stapling head or said at least one clincher.

2. The stapling device according to claim 1 wherein said two or more stapling heads (4, 5) or said at least two clinchers (13, 14) are movably disposed in a guide (8, 17, 18).

3. The stapling device of claim 1 or 2 wherein said clincher drive unit (9, 20, 29, 30, 45, 46) is electrically, electronically, pneumatically or hydraulically actuated.

4. The stapling device of claim 2 further comprising a collision sensor.

5. The stapling device of claim 2 wherein said at least one clincher and clamping device is separate from a guide (8) for moving the stapling heads.

6. The stapling device of claim 1 wherein said clinchers (13, 14), and said clincher drive unit 22 is coupled to said stapling head drive unit (12) for said at least one stapling head (4, 5).

7. The stapling device of claim 1 wherein said at least two clinchers and said two or more stapling heads include a linear guide.

8. The stapling device of claim 1 further comprising a guide (8) rigidly joined with said staple carriage (2).

9. The stapling device of claim 8 wherein said guide is a linear guide supported against said staple carriage (2) along substantially the entire length of said linear guide.

10. The stapling device of claim 1 wherein said clincher drive unit is a spindle drive (9, 10, 19, 20) for setting the distance between said two or more stapling heads (4, 5) and said two clinchers (14, 15).

11. The stapling device of claim 1 or 2 further comprising a position sensor for at least one stapling head position or at least one clincher position.

12. The stapling device of claim 1 or 2 further comprising a reference position on said at least one stapling head or said at least one clincher.

13. The stapling device of claim 1 or 2 further comprising a position controller.

14. The stapling device of claim 1 wherein said clamping device includes a locking device (34, 35, 36, 37) for said at least one stapling head (4, 5) or said at least one clincher.

15. The stapling device of claim 14 further comprising a drive for actuating said locking device.

16. The stapling device of claim 15 wherein said drive for actuating the locking device is electrically, pneumatically or hydraulically actuated.

17. The stapling device of claim 15 wherein said drive includes a force transmission device (38, 39).

18. The stapling device of claim 1 wherein the clamping device includes a clamping component (29) fixed relative to the staple carriage (2).

19. The stapling device of claim 18 wherein said clamping component (34, 35, 36, 37) is moveable and is connected to said at least one stapling head (4, 5).

20. The stapling device of claim 1 wherein said pressure component for said clamping device is provided by a pressure piston (14, 35, 35, 37).

21. A stapling device with at least two stapling heads for stapling sheet-like material, wherein the improvement comprises a staple carriage having said at least two stapling heads wherein at least one stapling head (4, 5) is adjustable to the other and a staple head drive unit (9, 10, 45, 46) is provided for setting the distance between the stapling heads (4, 5) and a clincher assembly having at least two clinchers (13, 14) and a clincher drive unit (19, 20, 45, 46) wherein at least one of said two clinchers is moveable to the other and a position sensor means for sensing the at least one stapling head position or at least one clincher position in a proper reference position and said at least two stapling heads and said clincher assembly move longitudinally in substantially synchronous movement with said sheet like material during stapling.

22. A stapling device with at least two stapling heads for stapling sheet-like material, wherein the improvement comprises a staple carriage having said at least two stapling heads wherein at least one stapling head (4, 5) is adjustable to the other and a staple head drive unit (9, 10, 45, 46) is provided for setting the distance between the stapling heads (4, 5) and a clincher assembly having at least two clinchers (13, 14) and a clincher drive unit (19, 20, 45, 46) wherein at least one of said two clinchers is moveable to the other and a position sensor means for sensing the at least one stapling head position and at least one clincher position in a proper reference position and said at least two stapling heads and said clincher assembly move longitudinally in substantially synchronous movement with said sheet like material during stapling.

* * * * *